US005313863A

United States Patent [19]

Aihara et al.

[11] Patent Number: 5,313,863

[45] Date of Patent: May 24, 1994

[54] APPARATUS FOR FORMING SLITS

[75] Inventors: Kintaro Aihara, Chiba; Tadashi Honda, Tokyo, both of Japan

[73] Assignee: Nippon Petrochemicals Co., Ltd., Tokyo, Japan

[21] Appl. No.: 778,863

[22] PCT Filed: May 1, 1991

[86] PCT No.: PCT/JP91/00599

§ 371 Date: Jan. 20, 1992

§ 102(e) Date: Jan. 20, 1992

[87] PCT Pub. No.: WO91/17026

PCT Pub. Date: Nov. 14, 1991

[30] Foreign Application Priority Data

May 1, 1990 [JP] Japan ..... 2-111837

[51] Int. Cl.[5] ..... B26D 1/40; B26D 7/14; B26F 1/20

[52] U.S. Cl. ..... 83/171; 83/175; 83/346; 83/660; 83/678

[58] Field of Search ..... 83/18, 175, 332, 344, 83/346, 347, 674, 675, 678, 169, 171, 660

[56] References Cited

U.S. PATENT DOCUMENTS 3,875,836 4/1975 Hutchinson et al. ..... 83/18
4,691,606 9/1987 Johnson et al. ..... 83/346

FOREIGN PATENT DOCUMENTS 0255406 2/1988 European Pat. Off. .
32-14306 11/1957 Japan .
50-17710 6/1975 Japan .
61-19595 1/1986 Japan .
61-85393 6/1986 Japan .
6420288 2/1989 Japan .
6478794 3/1989 Japan .
761607 11/1956 United Kingdom .
1037711 8/1966 United Kingdom .
9002639 3/1990 World Int. Prop. O. .

*Primary Examiner*—Eugenia Jones
*Attorney, Agent, or Firm*—Bucknam and Archer

[57] ABSTRACT

A slit forming apparatus consists essentially of a rotary blade assembly, a rotary backing roller, and pressing projections. The rotary blade assembly contacts with or abuts against a strip-shaped material travelling over the rotary backing roller and then penetrates said material to form slits in it. The backing roller has banks for holding the strip-shaped material pressed by the rotary blade assembly, and also has grooves for receiving the blades of the rotary blade assembly when they penetrate the strip-shaped material. The pressing projections provided at opposite side ends of the assembly prevent the undersired movement of said material in the lateral or longitudinal direction. With this apparatus, substantially defect-free satisfactory slits are formed in the strip-shaped material.

14 Claims, 10 Drawing Sheets

APPARATUS FOR FORMING SLITS

BACKGROUND OF THE INVENTION

1. Field of the Invention

The present invention relates to an apparatus and method for continuously forming slits in a film.

2. Prior Art

Japanese Patent Publication No. Sho 61-11757 discloses an apparatus for forming slits in a film. The outline of this apparatus will be described hereunder.

Referring to FIGS. 17(*a*) and 17(*b*), a rotary blade assembly 1 is made of circular blades 12 having plural arcuated blade tips, the blades 12 being arranged around a shaft 11 in parallel with one another and at a predetermined interval or pitch between one blade and the adjacent one. By passing a film 3 through between the rotary blade assembly 1 and a backing roller 2, there is obtained a film having slits formed parallel to the length of the film and according to the shapes of the blades. FIG. 18 illustrates the film 3 in which slits are formed by this apparatus. Reference numeral 35 denotes slits formed in the film 3; and 34*a* and 34*b*, non-slit margins (regions near two side ends) of the film, respectively. The backing roller 2 is made of a high molecular material, e.g., rubber and plastics, in order to decrease wear of the blade tips of the expensive rotary blade assembly.

When a continuous operation is performed on a film with this apparatus, satisfactory proper slits cannot be obtained, and there is raised the problem that the film often tears in the subsequent stretching step. The service life of the backing roller made of a high molecular material is very short. Satisfactory slits cannot be formed by the continuous operation of this apparatus possibly because of various errors, e.g., unsatisfactory accuracy in sizes of the rotary blade assembly and the backing roller, an error in the rotation thereof, and non-uniformity in film thickness. For example, the rotating units such as the rotary blade assembly 1 and the backing roller 2 have a dimensional error caused when worked and an error exhibited during the rotation thereof. More specifically, these errors include off centering caused in this conventional apparatus by unsatisfactory perpendicularity of the circular blades to the axis 11 (or unsatisfactory parallelism between one circular blade and the adjacent one), unsatisfactory circularity of the section of the roller, insufficient precision of bearings and unsatisfactory accuracy in installation of this apparatus. Said errors also include non-uniformity of heights of individual blade tips of the circular blades and unevenness of the surface of the roller. Said errors further include considerable variation of the film in thickness. These various errors are superposably affect and cannot be avoided in machining.

When the backing roller has elasticity, an amount of elastic deformation varies depending on the extent of errors, and a push pressure proportional to the elastic deformation also varies accordingly. As a result, when slits are to be formed, the pressing forces at different portions of the film vary, failing to obtain satisfactory slits. The higher the running speed of the films is, the more remarkable the variation in pressing force is.

The surface portion of the backing roller 2 is made of a comparatively soft high molecular material, and it is thus very liable to be damaged and this damage will be quickly aggravated during the operation of this apparatus. Thus, in anticipation of such variation as above to some extent, the pressing force is generally adjusted.

However, if the pressing force is set to be smaller so that the damage is less worsened, then satisfactory slits will not be formed.

When the damage or injure in the surface portion of the backing roll 2 is substantial, V- or U-shaped cuts 25 are found in the surface portion as indicated in FIG. 19(*a*). Accordingly, to form satisfactory slits in a film, the pressing force of the rotary blade assembly and the like must always be adjusted.

In the above apparatus, the blade tips are heated. As is indicated in FIG. 19(*b*), as the damage or cuts 25 in the backing roller 2 are deepened, the area and time of contact between each of the blade tips of the circular blades 12 and the film 3 are increased so that the film is melted and the film fails to form trim slits. In addition, the film 3 tends to easily adhere to the blade tips when they are heated and, therefore, it cannot be fed uniformly whereby satisfactory slits are not formed thus causing the film to be frequently torn off in the subsequent stretching step. In this case, the backing roller 2 used must be replaced with a satisfactory one or repaired. The time for this replacement or repair indicates the end of service life of the backing roll 2. According to experience, the conventional backing roller 2 has a short service life ranging from several minutes to several tens of hours depending on the kind and thickness of films to be used, the film feeding velocity and the accuracy in manufacture of the blades and roll.

When the above apparatus is operated, the backing roll 2 is cooled. As the groove (damage) in the backing roll 2 is deepened, the coolant (water) comes to stay in the groove so that blade tips of the circular blades 12 are cooled too much thus failing to form slits in the film 3.

Further, the film 3 will raise a serious problem as to excessive adhesion of the film 3 to the blade tips when it is attempted to form lateral slits in the direction perpendicular to the lengthwise direction of the film.

FIG. 20 shows lateral slits 35. In this case, a tension in the longitudinal direction (direction of arrow X) of the film 3 is exerted mainly on slit-free margins (regions respectively near the ends of side of the film) 36. Therefore, as the grooves in the surface portion of the backing roller 2 are deepened, the central portion of the film 3 is shifted from the normal position A to a position B as shown in FIG. 21. As a result, the time of contact between the blade tips and the film 3 is further prolonged so that excessive melting of the film and adhesion to the blade tips is accelerated.

On the other hand, there has heretofore been known such an apparatus for perforating synthetic resin-made films as disclosed in Japanese Pat. Appln. Laid-Open No. Sho 58-7326. This conventional apparatus has a rotary heating roller provided on the peripheral surface with projections. In this apparatus, a rotary backing roller for backing a film is arranged opposite to the rotary heating roller and is provided on the peripheral surface with grooves which correspond to said projections. There is formed an adiabatic space between the projection and the groove corresponding thereto. Further, this known apparatus has a driving unit (ascent/descent-operating unit) for driving the rotary heating roller. When a film is to be passed without being perforated, the rotary heating roller is displaced at a standby position by the use of said driving unit. When a film is to be perforated, the rotary heating roller can be moved close to the rotary backing roller so that the projections on the peripheral surface of the rotary heating roller contact with (or abut against) the film.

In the case where the grooves of this apparatus are applied to the backing roller of the previously described apparatus, the problem that satisfactory slits are not formed in the film due to the various errors or defects, and the slit-formed film is less torn off by stretching when subjected to stretching in the subsequent step. Further, the service life of the backing roller is not shortened.

However, in the case where it is assumed that the above technique is applied to an apparatus for forming longitudinal slits and grooves are formed in the peripheral surface of a backing roller and in the peripheral direction thereof, a film will partially droop into the grooves when blade tips abut against the film whereby satisfactory longitudinal slits cannot be formed. The film droops into the outermost grooves deeper than the inner ones. Even if the blade tips are heated to melt the film, there will be still raised a problem as to the drooping of the film depending on the relationship between the slit forming speed and the film melting speed. It would be thought of at this point to prevent the film from drooping into the grooves by increasing the tension applied to the film in the longitudinal direction thereof and strengthening the frictional power between the film and the backing roller, but the prevention cannot surely be achieved. In the case where it is assumed that the above technique is applied to an apparatus for forming lateral slits and the backing roller is provided on the peripheral surface with grooves in the axial direction of the backing roller, no tension can be applied to the film in the longitudinal direction. Thus, the film cannot be prevented from drooping into the grooves so that it is difficult to form slits. In addition, there is raised a problem that the central portion of the film is shifted to the rotary blade assembly, as shown in FIG. 21. If the driving unit of the above conventional apparatus is assumed to the applied to this apparatus, the blades for forming lateral slits will not enter the grooves of the roller when the rotary blade assembly is caused to approach the backing roller, thus damaging the blades.

SUMMARY OF THE INVENTION

It is, therefore, an object of the present invention to provide a slit forming apparatus which can easily form substantially defect-free satisfactory slits in a film at a high speed, allows a backing roller to have a very long service life and enables a long-term continuous operation.

In one aspect of the present invention, there is provided a slit forming apparatus comprising a longitudinal slit forming means for contacting blades with a strip-shaped material in the longitudinal direction thereof for subsequent formation of longitudinal slits in said material, a backing means for backing the strip-shaped material so contacted and receiving the slit forming means in grooves of the backing means when the slit forming means penetrates the strip-shaped material, and a controlling means for pressing at least the margins respectively near the opposite side ends of the strip-shaped material onto the backing portion of the backing means so that the lateral movement of the material is controlled.

In another aspect of the present invention, there is provided a slit forming apparatus comprising a lateral slit forming means for contacting blades with a strip-shaped material in the lateral direction thereof for subsequent formation of lateral slits in said material, a backing means for backing a portion of the thus contacted strip-shaped material, the portion being other than the regions (margins) respectively near the opposite side ends of said material on backing portions of the backing means, and also for receiving the lateral slit-forming means in recesses (grooves) of the backing means when the slit-forming means penetrates the strip-shaped material, and a controlling means for pulling said regions (margins) away from the lateral slit-forming means to press the strip-shaped material onto the non-slit portion so that the longitudinal movement of the strip-shaped material is controlled.

In still another aspect of the present invention, there is provided a slit forming apparatus comprising a lateral slit forming means for contacting blades with a strip-shaped material in the lateral direction thereof for subsequent formation of lateral slits, a backing means for backing the strip-shaped material so contacted and receiving the lateral slit forming means in recesses of the backing means when said slit forming means penetrates the strip-shaped material, a shifting means for shifting the lateral slit forming means and backing means to a first position where slits are formed and then to a second position where slits are not formed, and a guide means for guiding at least one of the lateral slit forming means and the backing means so that the lateral slit means is received in recesses of the backing means when said slit forming means and said backing means are positioned at the first position.

In a still further aspect of the present invention, there is provided a method for forming slits which is characterized by pressing a first slit forming blade through a strip-shaped material onto a backing member so that slits are formed in the strip-shaped material while forming recesses corresponding the first slit forming blade in the backing member. In this case, it is advisable to guide, after the formation of recesses with the first slit forming blade, a second slit forming blade of less precision than the first slit forming blade through the strip-shaped material to the recesses of said backing member so that slits in the strip-shaped material are formed.

DETAILED DESCRIPTION OF THE PREFERRED EMBODIMENTS

The preferred embodiments of the present invention will be described with reference to the accompanying drawings.

Figure 1:
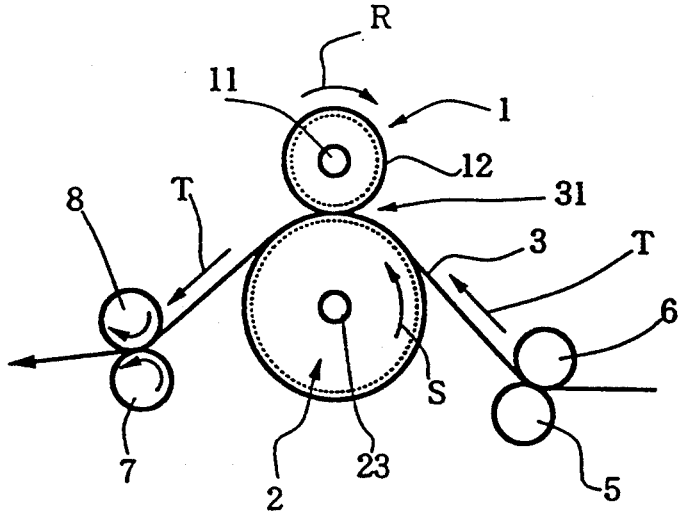
FIG. 1 is a sectional view of a slit forming apparatus according to an embodiment of the present invention.
Figure 2:
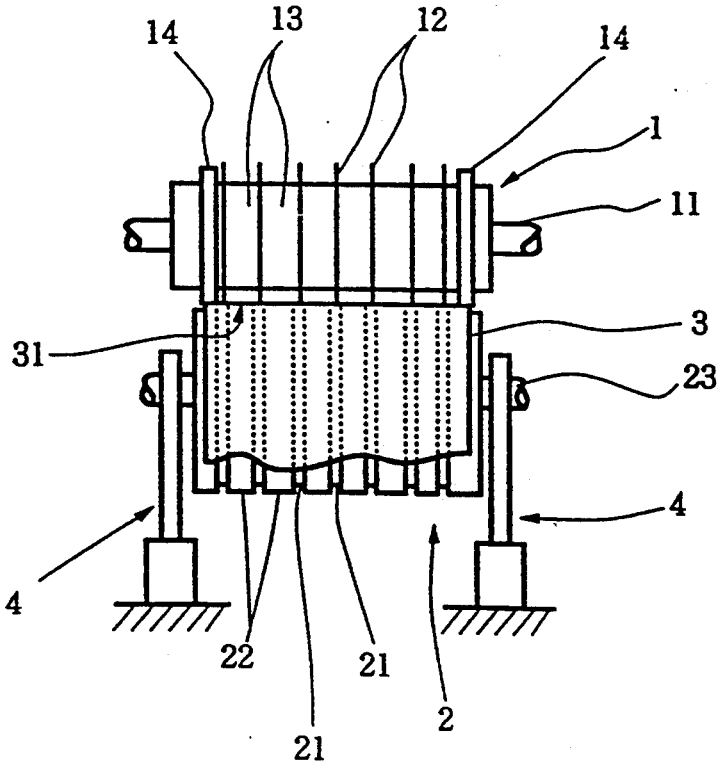
FIG. 2 is a front view of the slit forming apparatus of FIG. 1.

FIGS. 1 and 2 are sectional and front views, respectively, of a slit forming apparatus according to the first embodiment of the present invention.

The slit forming apparatus of FIGS. 1 and 2 is an example of an apparatus for forming slits in a film in the longitudinal direction (the direction in which a film runs). A rotary blade assembly 1 is assembled by arranging circular blades 12, each having plural arcuated blade tips at its distal end, around a shaft 11 at a predetermined pitch or interval with each circular blade sandwiched in between spacers 13. A backing roller 2 rotates about its axis 23 at, e.g., the same rotating speed as the rotary blade assembly 1. Grooves (recesses) 21 and banks 22 are alternately arranged on the surface of the backing roller 2. The banks 22 constitute the peripheral or circumferential surface of the backing roller 2. Note that the term "peripheral surface" used herein is defined not to include the inner surfaces of the grooves. The grooves 21 are provided so as to correspond to the positions where the blade tips of the circular blades 12 of the rotary blade assembly 1 contact with the film 3. Pressing projections 14 are provided at opposite outermost sides of the surface of the rotary blade assembly 1 to press the film 3 against the banks 22 of the backing roller 2. The backing roller 2 is pressed against the rotary blade assembly 1 by pressing mechanisms 4.

An arrow R indicates the rotating direction of the rotary blade assembly 1, an arrow S indicates the rotating direction of the backing roller 2, and an arrow T indicates the longitudinal direction of the film 3 which is a thermoplastic resin film for example. The film 3 passes through between feeding rollers 5 and 6 and then through between the rotary blade assembly 1 and backing roller 2 along the peripheral surface of the backing roller 2. Slits are formed in the film 3 at contact portions 31 between the arcuated blade tips of the circular blades 12 and the film 3, and the film 3 is then withdrawn by pinch rollers 7 and 8 through therebetween. A predetermined tension is applied to the film 3 passing in the longitudinal direction thereof through between the rotary blade assembly 1 and the backing roller 2 by the pulling force of the pinch rollers 7 and 8.

Figure 3:
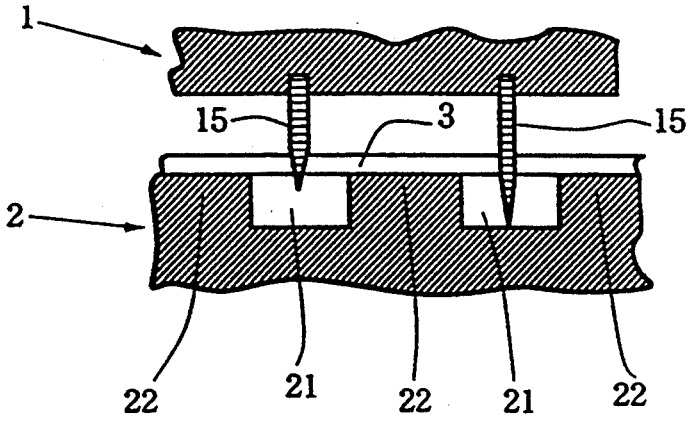
FIG. 3 is a sectional view showing blade tips penetrating a film.

FIG. 3 is an enlarged sectional view of the contact portions 31 of the blade tips of the rotary blade assembly 1 and the film 3 in the slit forming apparatus of FIG. 1. As shown in FIG. 3, each blade 12 of the rotary blade assembly 1 has plural blade tips 15. The backing roller 2 has the grooves 21 and the banks 22. The film 3 contacts the backing roller 2 at the banks 22 of the backing roller 2. A tension is applied to the film 3 in the longitudinal direction (the lengthwise direction) of the film by the pulling force of the pinch rollers 7 and 8. As a result, a friction is generated by contact of the banks 22 of the backing roller 2 and the film 3 to hold the film 3 above the grooves 21. In addition, since the opposite sides or margins of the film 3 are pressed by the pressing projections 14, the lateral movement of the film 3 is prevented. As the film 3 is held in this manner, the arcuated blade tips of the blades 12 of the rotary blade assembly 1 contact and press the film 3 whereby a tension is applied to the film 3 in the lateral direction (widthwise direction) of the film 3. The tension facilitates the blade tips of the blade 12 to easily penetrate the film 3. At this time, because of the presence of the grooves 21, the blade tips of the rotary blade assembly 1 are received in the grooves 21 and do not contact the peripheral surface of the backing roller 2.

As described above, when slits are to be formed in the longitudinal direction of the film 3, a tension is applied to the film 3 in the machine direction, i.e., the longitudinal direction, and the lateral movement of the film 3 is prevented. As a result, the film 3 is held so as to bridge over the banks 22 contiguous to the grooves 21 of the backing roller 2. When the blade tips on the distal ends of the blades 12 of the rotary blade assembly 1 contact and press the film 3, the tension is applied to the film 3 in the lateral direction to allow the blade tips to easily penetrate the film 3. The blade tips of the rotary blade assembly 1 can easily penetrate the film 3 because of this tension. As a result, substantially defect-free, satisfactory slits are formed in the film 3 easily at a high speed.

Because of the presence of the grooves 21, the blade tips do not contact with the peripheral surface of the backing roller 2. Hence, the service life of the backing roller 2 is conspicuously prolonged, enabling this roller 2 to perform a long-term continuous operation.

Figure 4:
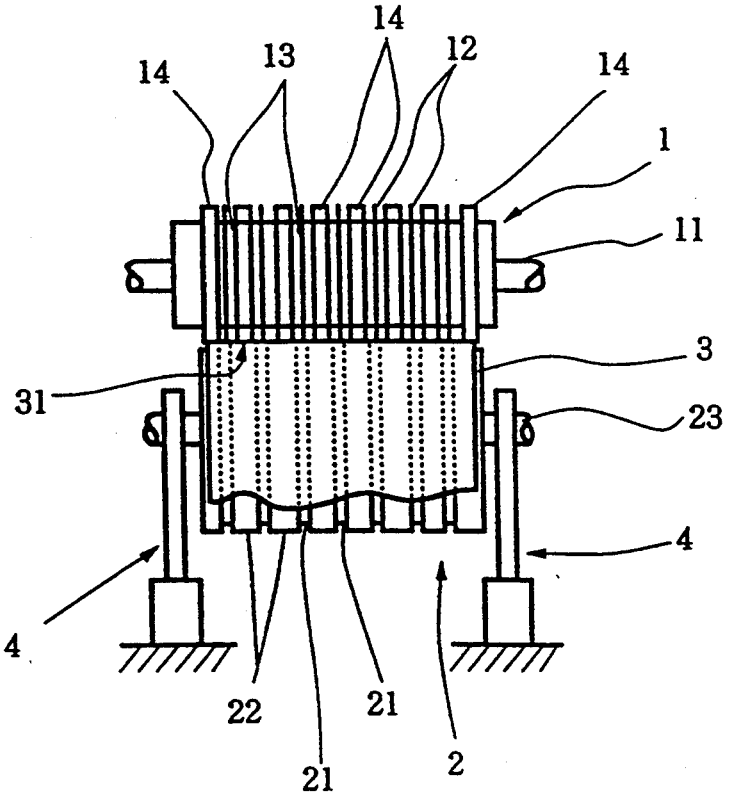
FIG. 4 is a front view of a slit forming apparatus according to another embodiment of the present invention.
Figure 5:
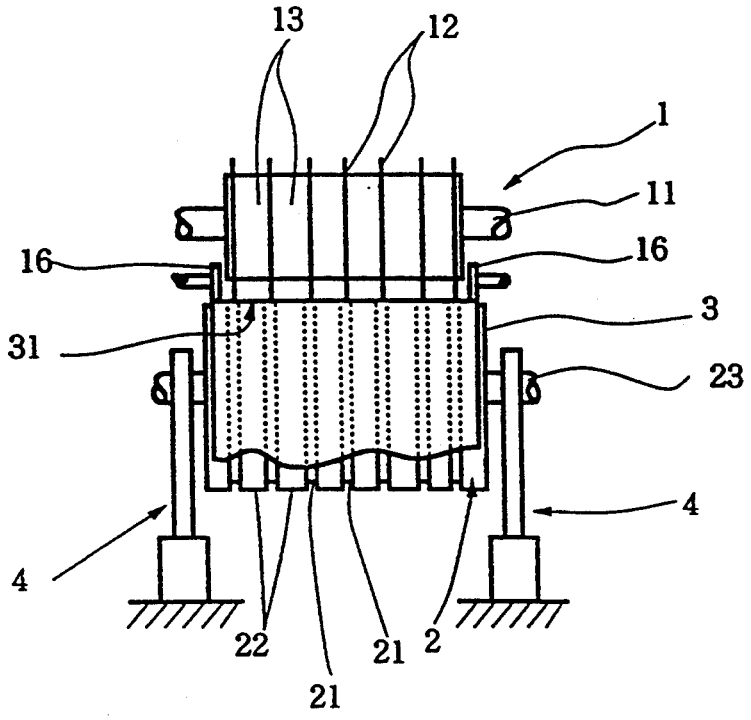
FIG. 5 is a front view of a slit forming apparatus according to still another embodiment of the present invention.

As shown in FIG. 4, the pressing projections 14 may each be provided between the two adjacent circular blades 12. Then, the lateral movement of the film 3 can be further prevented. As shown in FIG. 5, pressing rollers 16 which are used to press the opposite sides or margins of the film 3 may be provided in place of the pressing projections 14.

Figure 6:
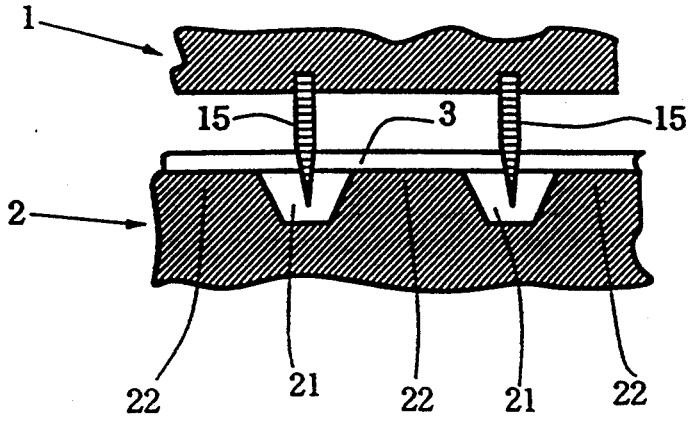
FIGS. 6 and 7 are sectional views, respectively, of a backing roller of the embodiments.
Figure 7:
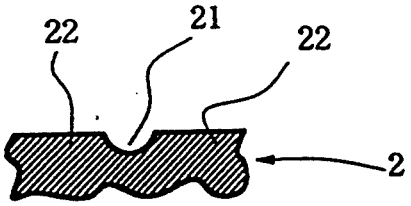

FIG. 6 shows another example of the grooves 21 of the backing roller 2. The grooves 21 of FIG. 3 have a rectangular section, whereas the grooves 21 of FIG. 6 have a trapezoidal section. FIG. 7 shows still another example of the grooves 21 of the backing roller 2. The groove 21 shown in FIG. 7 has a semi-circular section.

Figure 8:
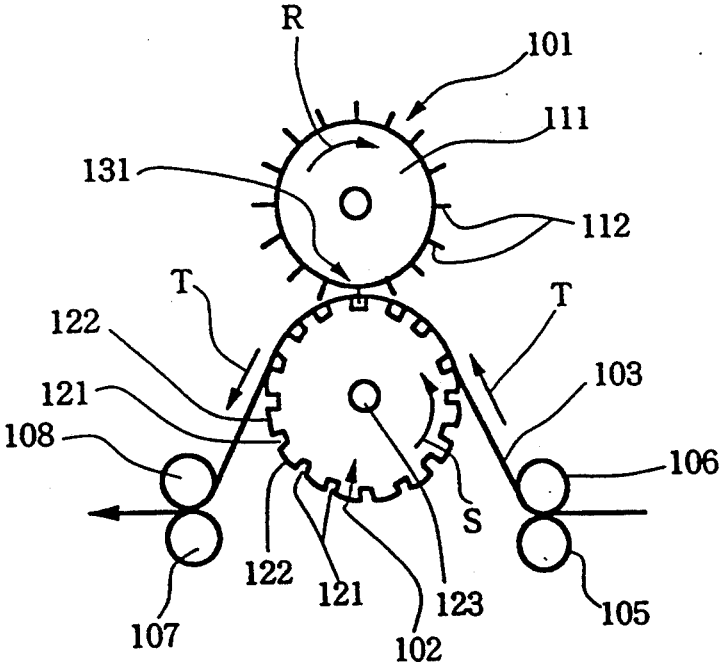
FIG. 8 is a sectional view of a slit forming apparatus according to still another embodiment of the present invention.
Figure 9:
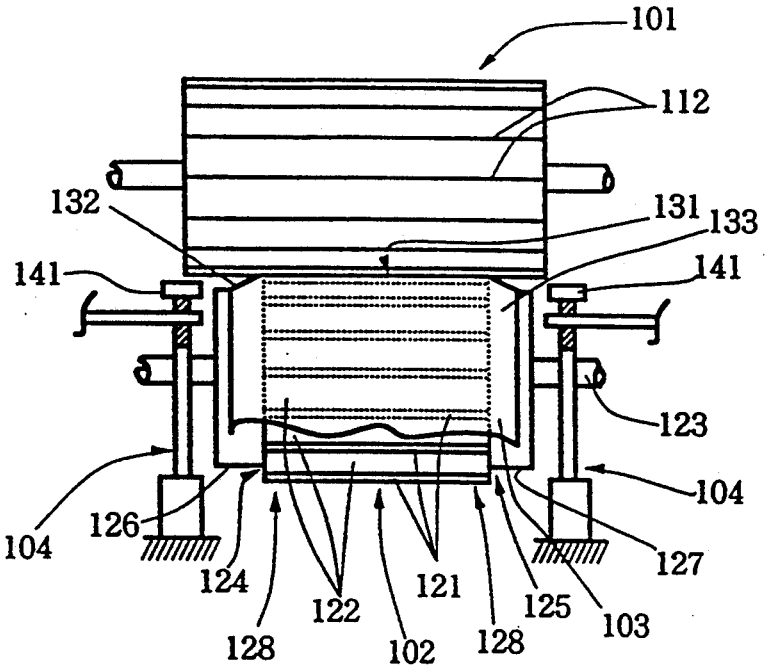
FIG. 9 is a front view of the slit forming apparatus of FIG. 8.

FIGS. 8 and 9 are sectional and front views, respectively, of a slit forming apparatus according to still another embodiment of the present invention.

The slit forming apparatus of the FIGS. 8 and 9 is an example of an apparatus for forming slits in a film 103 in a lateral direction (widthwise direction of the film). A rotary blade assembly 101 is obtained by planting sharp thin blades 112, each having a length smaller than the width of the film 103, in grooves formed in the peripheral or circumferential surface of a cylindrical body 111 at an equal interval in the lengthwise direction of the body 111. The blades 112 each have plural segmental blade tips. A backing roller 102 rotates about its axis 123 at the same peripheral speed as that of the rotary blade assembly 1. Grooves 121 and banks 122 are alternately provided on the surface of the backing roller 102. The banks 122 constitute the peripheral surface of the backing roller 102. Note that the term "peripheral surface of the backing roller 102" used herein is defined not to include the inner surface of the grooves of the roller 102. The grooves 121 are so provided as to correspond to positions where the blades 112 of the rotary blade assembly 101 contact the film 103, respectively. Steps 124 and 125 are formed on the respective edges of the backing roller 102. The diameter of the backing roller 102 at portions 126 and 127 outside the steps 124 and 125 is smaller than that at portions inside the steps 124 and 125 (the portions where the grooves 121 and the banks 122 are provided), respectively. The length of each bank 122 is smaller than the width of the film 103 because of the presence of steps 124 and 125. More specifically, the unslit margins (edge portions) of the film 103 are off from the banks 122. The backing roller 102 is pressed against the rotary blade assembly 101 by a pressing mechanism 104. In this case, the rotary blade assembly 101 and the backing roller 102 are held with a predetermined gap therebetween by a stopper 141 serving as a spacer mechanism.

As arrow R indicates the rotating direction of the rotary blade assembly 101, an arrow S indicates the rotating direction of the backing roller 102, and an arrow T indicates the longitudinal direction of the thermoplastic resin film 103. The film 103 passes through between convey rollers 105 and 106 and runs through between the rotary blade assembly 101 and the backing roller 102 over the peripheral surface of the backing roller 102. Slits are formed in the film 103 at contact portions 131 between the blade tips of the blade 112 and the film 103, and the film 103 is withdrawn by convey rollers 107 and 108 for conveying the unslit margins of the film 103.

The convey rollers 107 and 108 are provided to convey the unslit margins of the film 103. Upon application of the tractive force by the convey rollers 107 and 108 to the film 103, unslit margins 132 and 133 thereof running between the rotary blade assembly 101 and the backing roller 102 are pulled in a direction to separate from the rotary blade assembly 101 and are then bent toward the backing roller 102 side, as shown in FIG. 9. Upon bending, a predetermined tension is applied to the film 103 in the lateral direction (widthwise direction of the film 103). Because of this lateral tension, the longitudinal movement of the film 103 is prevented by the friction between the banks 122 of the backing roller 102 and the film 103, and the film 103 is held above the grooves 121. When the film 103 is held in this manner, the blade tips at the distal ends of the blades 112 of the rotary blade assembly 101 abut against and press the film 103. Then, a tension is generated in the film held above the grooves 121, in the longitudinal direction (lengthwise direction of the film 103). This tension allows the blade tips of the blade 112 to easily penetrate the film 103. At this time, because of the presence of the grooves 121, the blades 112 of the rotary blade assembly 101 are received in the grooves 121 and do not contact the peripheral surface of the backing roller 102. The grooves 121 can be rectangular in section, trapezoidal in section, semi-circular in section, or similarly shaped in section, as described above.

When slits are formed in the film 103 in the lateral direction, such tension in the longitudinal direction is not applied to the film 103. For this reason, steps 124 and 125 are formed at the edges of the backing rollers 102 to bend the side or lateral edge portions 132 and 133 of the film 103 by the longitudinal tension of the film 103 at the margins 132 and 133. Then, a tension in the lateral direction is generated in the film 103. Because of this lateral tension, the film 103 is held by a predetermined friction to bridge over the banks 122 existing alternately with the grooves 121 of the backing roller 102. Since the film 103 is held at the banks 122 by the friction, when the blade tips of the blade 112 of the rotary blade assembly 1 abut against the film 103 over the grooves 121 to urge it into the grooves 121, a tension is applied to the film 103 in the longitudinal direction to allow the blade tips of the blade 112 to easily penetrate the film 103. By this tension, the blade tips of the blade 112 can easily penetrate the film 103. As a result, substantially defect-free, satisfactory slits can be formed in the film 103 easily at high speed. Because of the presence of the grooves 121, the blades 112 are received in the grooves 121 and do not contact the peripheral surface of the backing roller 102. As a result, the service life of the backing roller 102 is remarkably prolonged, and a long-term continuous operation of the slit forming apparatus is enabled.

Figure 10:
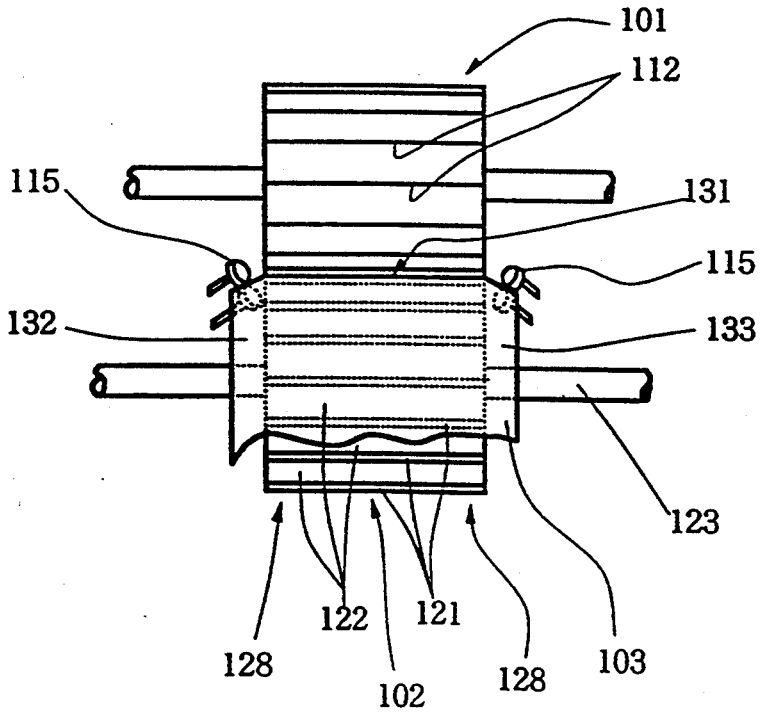
FIGS. 10 and 11 are front views of slit forming apparatuses according to other embodiments of the present invention, respectively.

The means for pressing the film against the banks to prevent the movement of the film in the longitudinal direction is not limited to these examples. As shown in FIG. 10, a plurality of aslant convey rollers 115 may be provided to clamp and convey the unslit margins 132, 133 of the film 103 in the direction to separate from the rotary blade assembly 101 and diagonally to the rotating direction of the backing roller 102.

Figure 11:
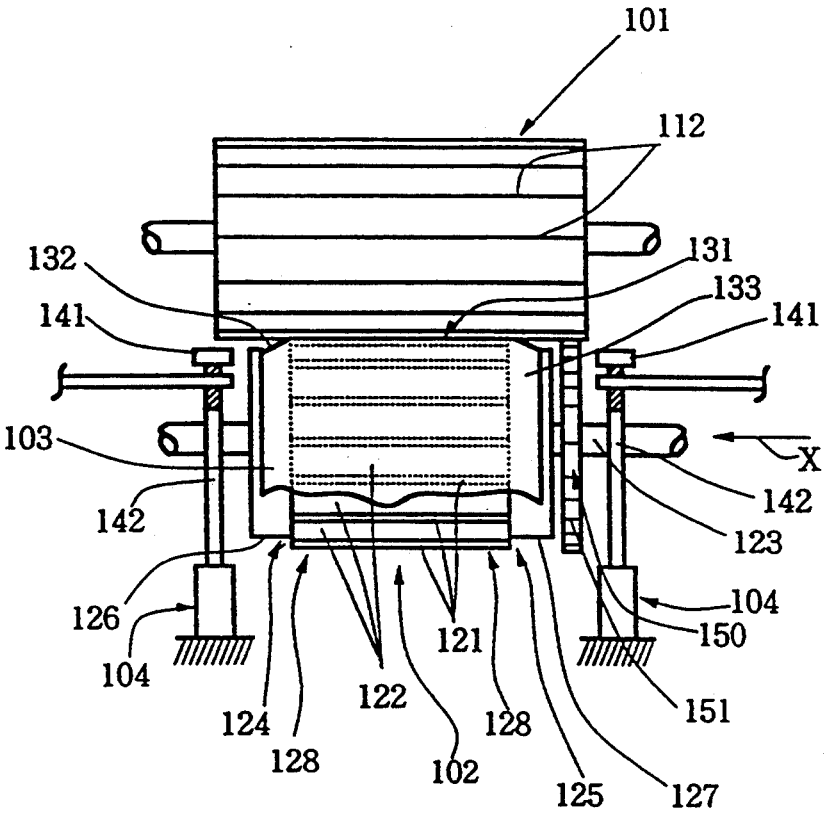

FIG. 11 is an example in which, in addition to the arrangement of FIGS. 8 and 9, a guide gear (guide means) 150 is provided to relatively position a rotary blade assembly 101 and a backing roller 102 so that blades 112 of the rotary blade assembly 101 enter in grooves 121 of the backing roller 102. The same reference numerals denote the same parts as in FIGS. 8 and 9, and a detailed description thereof is omitted. The guide gear 150 is fixed to shaft 123 of the backing roller 102. Reference numeral 104 denotes an elevating unit for the backing roller 102. The elevating unit 104 serves as a pressing mechanism by which the backing roller 102 is pressed against the rotary blade assembly 101. The elevating unit 104 is a cylinder to elevate the shaft 123 of the roller 102. The backing roller 102 can be separated from or moved close to the rotary blade assembly 101 by the elevating unit 104. When a film 103 is initially guided between the backing roller 102 and the rotary blade assembly 101, the backing roller 102 and the rotary blade assembly 101 are preferably separated from each other to easily guide the film 103 to therebetween. When a thermoplastic resin film is used as the film 103 and the rotary blade assembly 101 is heated, the backing roller 102 and the rotary blade assembly 101 must be separated from each other. Otherwise, the film 103 cannot be guided between them. For this purpose, the roller 102 is separated from the rotary blade assembly 101 by the elevating unit 104.

Figure 12:
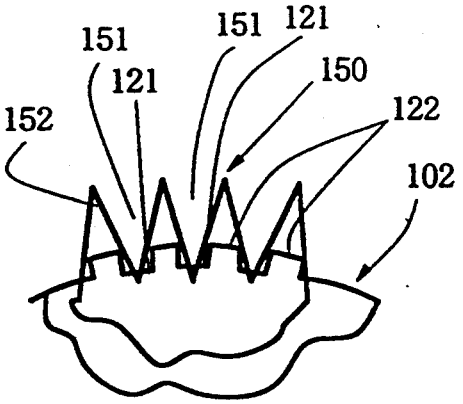
FIGS. 12 and 13 are views showing the positional relationship between the grooves of a backing roller and a guide gear of the slit forming apparatus of FIG. 11.
Figure 13:
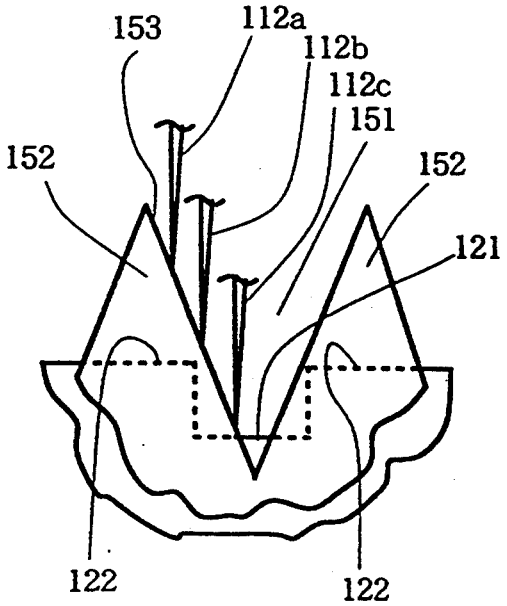

FIG. 12 is a view of the guide gear 150 and the backing roller 102 of FIG. 11 seen from a direction of an arrow X, and FIG. 13 is a partially enlarged view of the same. The guide gear 150 has guide teeth 152 and bottom portions 151. As shown in FIG. 12, the guide gear 150 is fixed so that its bottom portions 151 correspond to the grooves 121 of the backing roller 102 and tooth crests of the guide teeth 152 correspond to the banks 122 of the backing roller 102. The guide gear 150 meshes with the blades 112 of the rotary blade assembly 101.

As the backing roller 102 spaced apart from the rotary blade assembly 101 is gradually moved close to the assembly 1 by the elevating unit 104, a blade 112 of the rotary blade assembly 101 contacts with a flank 153 of a certain guide tooth 152 in such a manner as indicated by way of a blade 112*a* of FIG. 13. As the backing roller 102 is moved closer to the rotary blade assembly 101, the blade 112*a* so contacting the flank is guided from a position of a blade 112*a* to a position of a blade 112*c*. As a result, the blade 112 is positioned in the groove 121 of the backing roller 102.

In this embodiment, the guide gear (guide means) 150 is provided to relatively position the rotary blade assembly 101 and the backing roller 102 so that the blades 112 of the rotary blade assembly 101 enter in the grooves 121 of the roller 102. Therefore, when the rotary blade assembly 101 and the backing roller 102 are moved close to each other, the blades 112 are received in the grooves 122 without failure, and the blades 112 are not thus damaged.

In the embodiments described above, grooves are formed in the backing roller at positions corresponding to positions where each of the blades contacts with the film. Each blade does not contact with the backing roller immediately after it contacts with the film. As a result, the blade contacts the portions of the film which are held by the banks existing alternately with the grooves of the backing roller and which are above the grooves (portions of the film spanned above the hollow portions of the grooves). The dimensional precision of the rotary blade assembly and the backing roller need not be very high, and no particular consideration is needed for dimensional errors. Adjustment that has been conventionally performed due to the dimensional precision and errors is almost not needed. Adjustment of the pressing force to be applied to the rotary blade assembly and the backing roller is almost not needed.

In the embodiments, when the depth of the grooves in the backing roller is set to be larger than the variation (variation of precision) in height of the blades or the backing roller, the blades will not contact the bottom portions in the grooves of the backing roller. In this manner, the backing roller will not be damaged by the blades regardless of its material, resulting in that the backing roller can have a remarkable long service life. In addition, damage done to the blades will also be small. In this case, the rotary blade assembly and the backing roller are held with a predetermined gap kept therebetween by a spacer mechanism.

In this manner, according to the apparatuses of the embodiments, substantially defect-free, satisfactory slits can be formed at a high speed in various types of films made of, e.g., a polyolefine such as polyethylene and polypropylene; polyester; polyamide; polyvinyl chloride, and polycarbonate.

Figure 14:
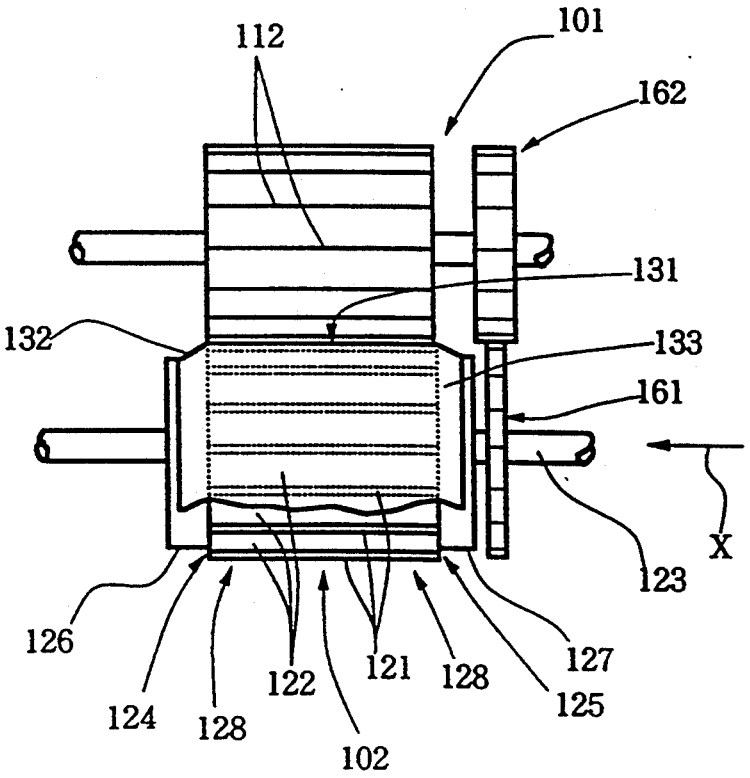
FIG. 14 is a front view of a slit forming apparatus according to still another embodiment of the present invention.

In the embodiment of FIG. 11, the guide gear 150 is provided to guide the blades 112 of the rotary blade assembly 101. However, as shown in FIG. 14, a first guide gear 161 that rotates in synchronism with a backing roller 102, and a second guide gear 162 that rotates in synchronism with a rotary blade assembly 101 may be provided. When the backing roller 102 is moved close to the rotary blade assembly 101, the first and second guide gears 161, 162 mesh with each other. An elevating unit and a stopper are not shown in FIG. 14.

Figure 15:
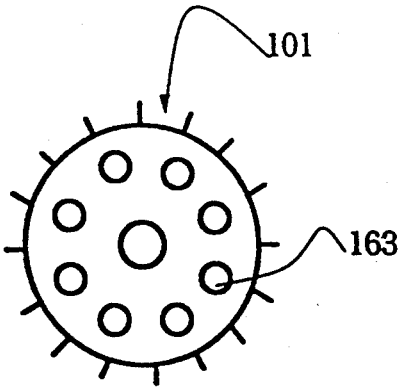
FIG. 15 shows an example of a rotary blade assembly provided with heaters.
Figure 17A:
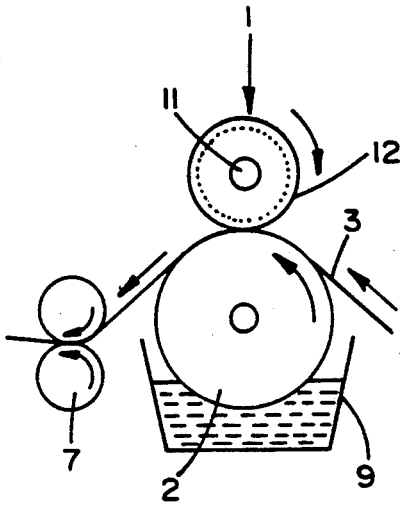
FIG.17(a) (PRIOR ART)
FIGS. 17(*a*) and 17(*b*) are sectional and front views, respectively, of a conventional slit forming apparatus.
Figure 17B:
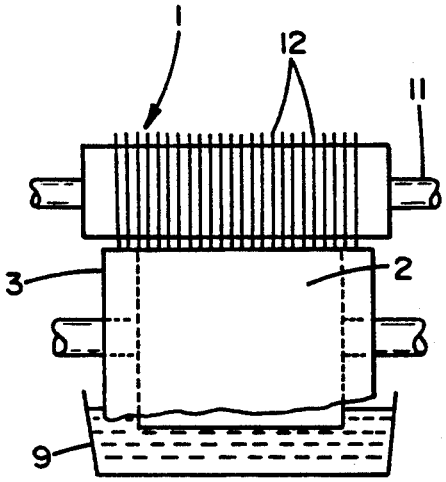
FIG.17(b) (PRIOR ART)
Figure 18:
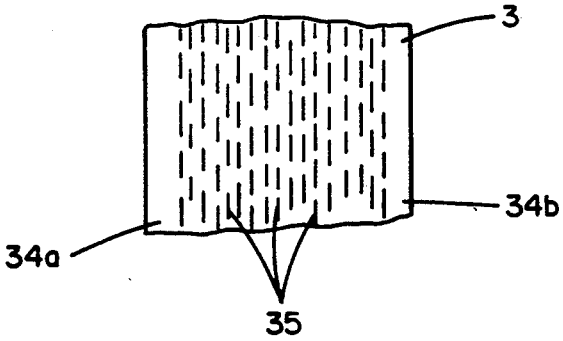
FIG.18 (PRIOR ART)
FIG. 18 is a plan view of a film in which slits are formed in the longitudinal direction.
Figure 19A:
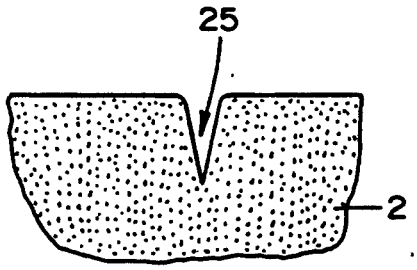
FIG.19(a) (PRIOR ART)
FIGS. 19(*a*) and 19(*b*) are schematic sectional views of a backing roller damaged by a prior art technique.
Figure 19B:
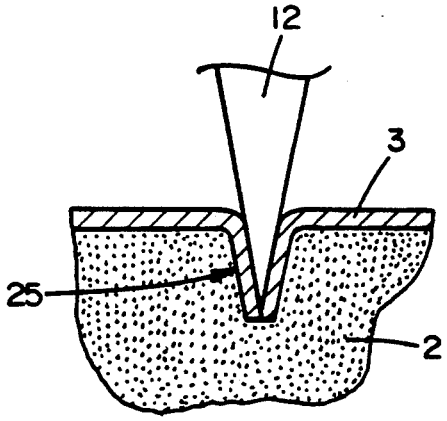
FIG.19(b) (PRIOR ART)
Figure 20:
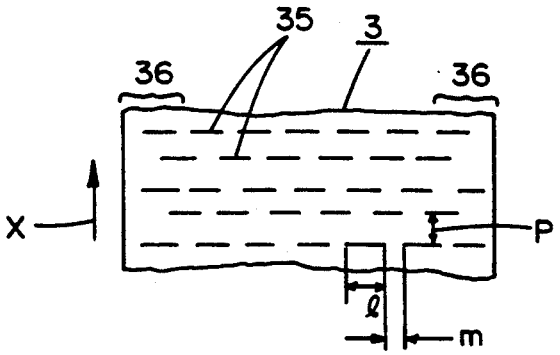
FIG.20 (PRIOR ART)
FIG. 20 is a plan view of a film in which slits are formed in the lateral direction.
Figure 21:
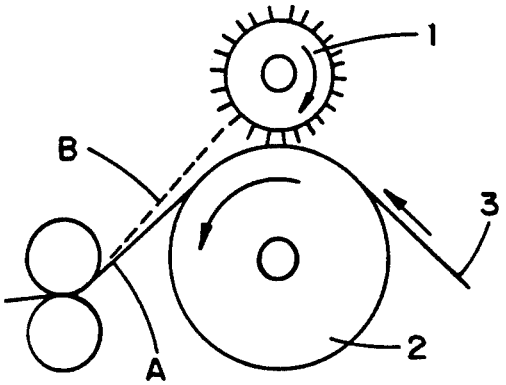
FIG.21 (PRIOR ART)
FIG. 21 is a sectional view of a film when slits are to be formed therein in the lateral direction in accordance with the prior art technique.

In the embodiments, the blades 12 (112) are not heated. However, when a thermoplastic resin film is used as the film 3 (103), the blades 12 (112) may be heated. If slits are to be formed in a thermoplastic resin film by heated blades, portions of the film contacting the heated blades are melted, thus forming relatively satisfactory slits. The rotary blade assembly 101 may be heated by, e.g., a heater 163 in the inner core of its shaft, as shown in FIG. 15, or by external heat radiation or an oil bath. The rotary blade assembly 1 for forming longitudinal slits may be heated in the same way as above. Any heating means can be used as far as it can heat the blades to a temperature higher than the melting point of the thermoplastic resin film. In this case, the backing roller may be cooled by, e.g., a method shown in FIGS. 17(*a*) and 17(*b*). The backing roller may be cooled by any cooling method such as a backing roller internal cooling method, a backing roller external cooling method, or an external water cooling method. The most simple and practical cooling is achieved by a method comprising externally blowing air. When the backing roller is cooled, the film will not be excessively melted, and the melted resin will not attach the blades when they are pulled off the film, thereby causing no difficulties in forming satisfactory slits. Further, the surface of the backing roller will not be degraded by the heat.

In the embodiments, because of the presence of the grooves 21 (121), the rotary blade assembly 1 (101) does not contact with the backing roller 2 (102) immediately after it contacts with or abuts against the film. However, after this contact or abutment, the blades 12 (112) of the rotary blade assembly 1 (101) may be either separated from or may contact the bottom portions in the grooves 21 (121) of the backing roller 2 (102). Namely, either method can be adopted as far as the blade tips of the rotary blade assembly 1 (101) do not contact with the peripheral surface of the backing roller 2 (102) (only the outer surfaces of the banks, not including the inner surfaces or flanks of the grooves). The left-hand sides of FIGS. 3 and 6 show examples in which a blade 12 is separated from the backing roller 2. The right-hand sides of FIGS. 3 and 6 show examples in which a blade 12 contacts the bottom portion in a groove of the backing roller assembly 1. It is preferable that the blades 12 (112) do not contact with the backing roller 2 (102) so that degradation of the blades 12 (112) can be prevented. The backing roller 2 (102) can be made of any material. A rigid material such as a metal is preferable from the viewpoint of a service life.

In the embodiments, the shape of the grooves 21 (121) to be formed in the backing roller 2 (102) can have a rectangular, trapezoidal, or semi-circular section. However, the present invention is not limited to this, and the grooves 21 (121) can have any shape as far as they do not contact with the peripheral surface of the backing roller 2 (102) when the blades 12 (112) of the rotary blade assembly 1 (101) contact with the film 3 (103).

If the depth of the grooves 21 (121) is set to be larger than the variation (variation in precision) in blade height, the blades 12 (112) will not contact with the bottom portions in the grooves and are thus preferable. The smaller the groove depth, the better the performance. If the grooves are excessively deep, the film 3

(103) may sometimes contact with the blades 12 (112) for a long period of time, and the film 3 (103) may be excessively melted if heated blades are used. In the embodiments, the blade 12 (112) comprises plural blade tips. However, the blade 12 (112) may comprise one blade tip.

The elevating unit (pressing mechanism) 4 (104) for the backing roller 2 (102) is not limited to that shown in FIG. 11, and a unit of any other type can be used. The rotary blade assembly 1 (101) may be elevated (may go up and down) in place of the backing roller 2 (102). The backing roller 2 (102) or the rotary blade assembly 1 (101) may be moved not only in an up-and-down direction but also in any optional direction. The guide gear 150 may not be meshed with the blades 112, but with something else. For example, a gear having non-flat distal ends may be used to smoothly mesh with the guide gear 150.

In the embodiments, the backing roller 2 (102) is pressed against the rotary blade assembly 1 (101). However, the rotary blade assembly 1 (101) may be pressed against the backing roller 2 (102).

When a film in which satisfactory slits are formed by the apparatuses of the embodiments is subjected to stretching, a net-like web can be fabricated without tearing the slit-formed film during stretching at a large magnification, i.e., 1.1 to 15 times.

As for the stretching method, the film in which slits are formed is subjected to rolling and/or stretching in the direction of the slits in a single or multiple steps. The stretched film may be made into a net-like web. The apparatuses of the embodiments are particularly effective for a resin film, e.g., a high-density polyethlene film, which allows a comparatively restricted machining condition, is difficult to stretch and is easy to tear by stretching.

Figure 16:
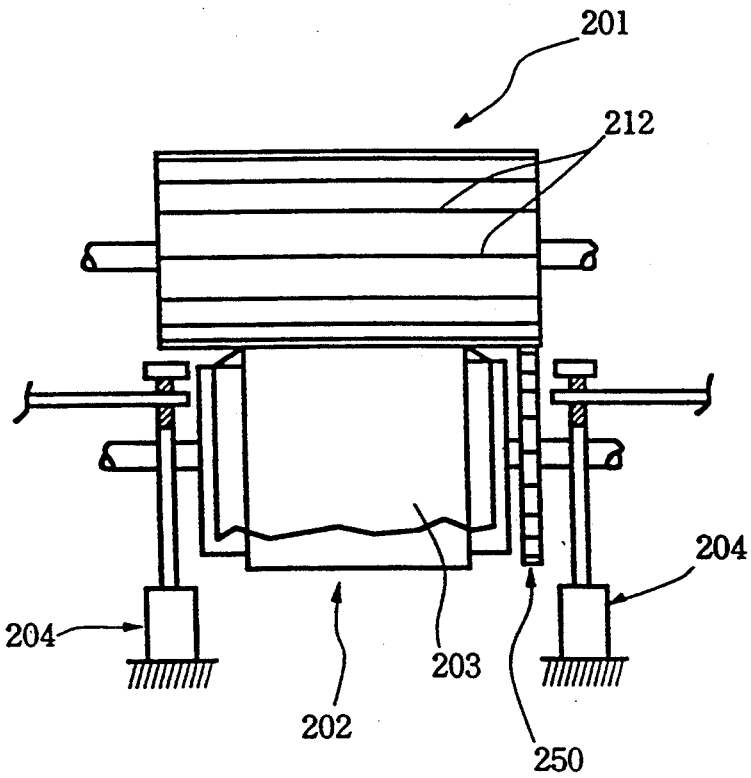
FIG. 16 is a front view of a slit forming apparatus according to still another embodiment of the present invention.

A slit forming method will be described with reference to FIG. 16. In the above embodiments, the slits are formed by using a grooved backing roller. With the method of FIG. 16, the grooves of the backing roller are formed while the slits are being formed.

A backing roller 202 having no grooves and made of a metal softer than that of the rotary blade assembly 201 is used. Slits are formed in the film 203 as the backing roller 202 is pressed against the rotary blade assembly 201 by the elevating unit 204. Then, grooves are formed in the surface of the backing roller 202 by the blades 212 of the rotary blade assembly 201. In this case, a rotary blade assembly 201 having a high precision must be used.

When the backing roller 202 is separated from the rotary blade assembly 201 once and thereafter is moved close to it, the blades 212 of the rotary blade assembly 201 are guided to already grooved portions in the surface of the backing roller 202 by a guide gear 250. Then, the grooves in the backing roller 202 are formed simultaneously with the formation of the slits.

Once the grooves of the backing roller 202 are completely formed, a rotary blade assembly 201 not having a very high precision is used.

In this manner, a backing roller 202 can be easily manufactured. The slits can be either longitudinal or lateral slits.

As has been described above, according to the slit forming apparatus of the present invention, when the slit forming means penetrates the film, it is received in recesses (grooves) of the backing material. Therefore, substantially defect-free satisfactory slits can be easily formed in various types of films at a high speed. The service life of the backing roller is remarkably prolonged, and a long-term continuous operation of the present apparatus is enabled.

What is claimed is:

1. A slit forming apparatus for forming slits in the lateral direction of a strip-shaped material, said strip-shaped material having a main central portion and side margin portions, which apparatus comprises a first rotating member having a rotation axis and a periphery and rotating in a first direction, a second rotating member having a rotation axis, said first rotating member having blades for forming lateral slits only in said main central portion, said blades having a longitudinal extension and being located on said periphery of said first rotating member such that said longitudinal extension is parallel to said rotation axis, said second rotating member having a peripheral surface and a backing portion for backing said main central portion and rotating in a second direction opposite to said first direction, said blades penetrating said strip-shaped material when said first rotating member rotates and said strip-shaped material passes between said first rotating member and said second rotating member, said second rotating member having recessed portions for receiving said blades when they penetrate said main portion; and conveying means for conveying said strip shaped material by pulling only said side margin portions in a third direction to separate said side margin portions from said first rotating member and to position said side margin portions at an angle with respect to said main central portion wherein said third direction is diagonal to said rotation axis of said second rotating member such that said main central portion passes between said first rotating member and said second rotating member and is pressed portions said backing portion, a tension along a part of said peripheral surface of said second rotating member is applied to said side margin portions, and the longitudinal movement of said strip-shaped material is controlled.

2. A slit forming apparatus for forming slits in the lateral direction of a strip-shaped material according to claim 1, which comprises a shifting means for shifting said first rotating member and said second rotating member to a first position where said blades penetrate said recesses and slits are formed and then to a second position where slits are not formed, and a guide means for guiding said first rotating member and said second rotating member whereby said blades are received in said recesses of the second rotating member when said first rotating member and said second rotating member are positioned at said first position.

3. The apparatus according to claim 2, wherein said recessed portions are located in said backing portion.

4. The apparatus according to claim 3, wherein said guide means has a blade guide gear rotating in synchronism with said first rotating member, said blades form lateral slits and said blade guide gear guides said blades.

5. The apparatus according to claim 3, wherein said guide means has a first guide gear rotating in synchronism with said second rotating member and a second guide gear rotating in synchronism with said first rotating member and said first and second guide gears mesh with each other when said second rotating member is moved close to said first rotating member.

6. The apparatus according to claim 2, which includes heating means for heating said blades to a temperature higher than the melting point of said strip-shaped material.

7. The apparatus according to claim 2, which includes means for cooling said second rotating member.

8. The apparatus according to claim 2, which comprises an elevating unit for raising said first or said second rotating member.

9. The apparatus according to claim 2, wherein said recessed portions in said second rotating member are grooves and said grooves alternate with banks.

10. The apparatus according to claim 9, wherein said guide means is a gear with teeth having bottom portions, said teeth have crests, and during operation the position of said bottom portions corresponds to the position of said grooves and the position of said crests corresponds to the position of said banks.

11. The apparatus according to claim 1, wherein said recessed portions are grooves in said backing portion in parallel with the rotation axis of the second rotating member.

12. The apparatus according to claim 1, wherein said backing portion is cylindrical and has a diameter, and said second rotating member has outer portions at both sides of said cylindrical backing portion, each outer portion having cylindrical shape and having a diameter smaller than said diameter of said cylindrical backing portion, whereby a step is formed between said backing portion and each outer portion.

13. The apparatus according to claim 1, wherein said blades have arcuated tips at the distal ends thereof.

14. The apparatus according to claim 1, wherein said second rotating member rotates at the same speed as said first rotating member.

* * * * *